US007007672B2

(12) United States Patent
Condemine et al.

(10) Patent No.: US 7,007,672 B2
(45) Date of Patent: Mar. 7, 2006

(54) INTERNAL COMBUSTION ENGINE STARTING SYSTEM

(75) Inventors: Eric Condemine, Viry le Chatillon (FR); Vincent Basso, Briis sous Forges (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 10/500,962

(22) PCT Filed: Jan. 8, 2003

(86) PCT No.: PCT/FR03/00032

§ 371 (c)(1),
(2), (4) Date: Jul. 8, 2004

(87) PCT Pub. No.: WO03/058053

PCT Pub. Date: Jul. 17, 2003

(65) Prior Publication Data

US 2005/0000494 A1 Jan. 6, 2005

(30) Foreign Application Priority Data

Jan. 10, 2002 (FR) ..... 02 00250

(51) Int. Cl.
*F02M 37/04* (2006.01)

(52) U.S. Cl. ..... 123/447; 123/179.17

(58) Field of Classification Search ..... 123/447, 123/446, 456, 467, 179.17
See application file for complete search history.

(56) References Cited

U.S. PATENT DOCUMENTS

| | | | | |
|---|---|---|---|---|
| 4,356,980 | A | 11/1982 | Krauss | |
| 5,074,263 | A | 12/1991 | Emerson | |
| 5,135,027 | A * | 8/1992 | Miki et al. | 137/596.17 |
| 5,529,387 | A * | 6/1996 | Mialkowski | 251/30.03 |
| 5,533,707 | A * | 7/1996 | Beesley | 251/129.15 |
| 5,758,865 | A | 6/1998 | Casey | |
| 5,839,413 | A | 11/1998 | Krause et al. | |
| 6,257,204 | B1 * | 7/2001 | Kamijo et al. | 123/456 |
| 6,273,395 | B1 * | 8/2001 | Palma et al. | 251/129.21 |
| 6,336,445 | B1 * | 1/2002 | Yamazaki et al. | 123/506 |
| 6,447,273 | B1 * | 9/2002 | Nishimura et al. | 417/505 |

FOREIGN PATENT DOCUMENTS

JP 09-184464 7/1997

* cited by examiner

*Primary Examiner*—Carl S. MIller
(74) *Attorney, Agent, or Firm*—Nicolas E. Seckel

(57) ABSTRACT

The invention relates to a starting system (1) for an internal combustion engine comprising pressurized fuel supply means (3), an accumulator means (2), which is supplied with pressurized fuel by said supply means, and at least one injection means (4) which is supplied with fuel by the accumulator means (2). According to the invention, the system also comprises a device for storing pressurized fuel (5), which is supplied due to the pressure in the accumulator means. At start-up, the aforementioned fuel storage device can supply the stored fuel in such a way as to provide a second fuel compression means which enables the engine to start up more rapidly. The invention is particularly suitable for use in the area of common-rail engines.

18 Claims, 1 Drawing Sheet

INTERNAL COMBUSTION ENGINE STARTING SYSTEM

The invention relates to a starting system for engines equipped with a fuel injection common rail.

Nowadays, automobile manufacturers seek technologies that would enable them to design less polluting automobiles. First, because the drivers of the vehicles are more sensitive than ever to ecology, but above all because the norms on exhausts that are passed are stricter and stricter.

One of the solutions envisioned by manufacturers to reduce polluting exhausts consists in stopping the engine when the latter is not sollicitated, such as, for example, at a red light. This technique is called more generally "stop and start". Indeed, stopping the engine will make it possible to reduce gasoline consumption, and thus, to reduce polluting exhausts. This exhaust reduction is significant, in particular in urban areas where the heavy concentration of road signs forces regular stops and where traffic jams form regularly.

This "stop and start" technique is easily applied with engine whose injection in each cylinder is controlled individually. However, this is not the case with engines equipped with a "common rail", which, for its part, manages injection into several cylinders at the same time. Indeed, the present start-up of these engines equipped with a common rail with a high pressure fuel jet is too slow for the "stop and start" technique to be applicable to them. This slowness is induced by the time required by the high pressure pump to compress the fuel present in the common rail up to the minimum pressure necessary for operation of the injectors. Thus, in order for the engines with common rail to be able to operate in "stop and start" mode, it is necessary to reduce their start-up time.

U.S. Pat. No. 5,839,413 discloses a system that makes it possible to reduce the start-up time of an engine equipped with a common rail. The principle of this system consists in setting up a communication between the common rail and not only a high pressure pump but also a low pressure circuit thanks to two weighed anti-backflow valves (a first, low pressure one, and a second, high pressure one). The low pressure circuit has a low pressure accumulator which makes it possible to maintain a stable pressure lower than that delivered when the high pressure pump is at full charge. Thus, during start-up, while the high pressure pump is started, the low pressure circuit already compresses the fuel in the common rail. Then, when the high pressure pump applies a pressure higher than that existing in the low pressure circuit, the low pressure valve, which until then was letting the low pressure flow pass, will close to the benefit of the second valve. The common rail is finally pressurized only by the high pressure pump.

The duration of the pressure raising is thus shortened thanks to this system. However, this technique is not satisfactory, on the one hand, because its implementation is too complex, and on the other hand, because it is not fast enough to make its application to the "stop and start" technique pleasant to use.

The objective of the present invention is to remedy all or part of the drawbacks mentioned above by proposing a simple starting system comprising a redundant compression means that can be easily integrated in order to adapt existing engines to the "stop and start" technique.

To this effect, the invention concerns a starting system for internal combustion engine comprising pressurized fuel supply means, accumulator means supplied with pressurized fuel by said supply means, and at least one injection means supplied with fuel by the accumulator means, characterized in that it further comprises a pressurized fuel storage device supplied thanks to the pressure existing in said accumulator means and in that said fuel storage device is adapted to supply said stored fuel at start-up so as to provide a second fuel compression means making it possible for said engine to start up more rapidly.

According to the invention, the storage device, in direct communication with said accumulator means, comprises advantageously at least one storage means and control means making it possible for said storage device to supply or recuperate selectively pressurized fuel.

Advantageously, said control means comprise, according to the invention, electromagnetic opening means, elastic closing means, and an actuator means selectively controlled by said electromagnetic means and said elastic means, making it possible to limit the energy to be supplied to control said starting system.

The electromagnetic means comprise advantageously according to the invention a coil generating a magnetic field adapted to move the actuator means and whose inner diameter forms a tunnel between said at least one storage means and the accumulator means.

Advantageously, the elastic means according to the invention comprise a spring, a hollow plate fixed between said electromagnetic means and said storage means, and a ball adapted to block the hollow of said plate and integral with said spring, enabling the communication between the accumulator means and said at least one storage means, depending on the relative pressures between the two.

In an advantageous way, the actuator means comprises, according to the invention, a first rod located essentially on the central axis of said tunnel formed by the coil, a plate fixed essentially perpendicularly to an extremity of said first rod, and a second rod that, as an extension of the other extremity of the first rod, is in contact with said ball and has a diameter smaller than the hollow of said plate, making it possible to follow or to initiate the movement of said ball.

The plate further comprises advantageously according to the invention at least one groove adapted to let fuel pass in its hollow when said plate is against said electromagnetic means.

According to the invention, the supply means comprise, advantageously, a pump supplying fuel to said accumulator means and an anti-backflow valve authorizing a fuel circulation direction only from the pump toward said accumulator means.

Other specificities and advantages will appear by reading the following description made in reference to the Figures in which.

Figure 1:
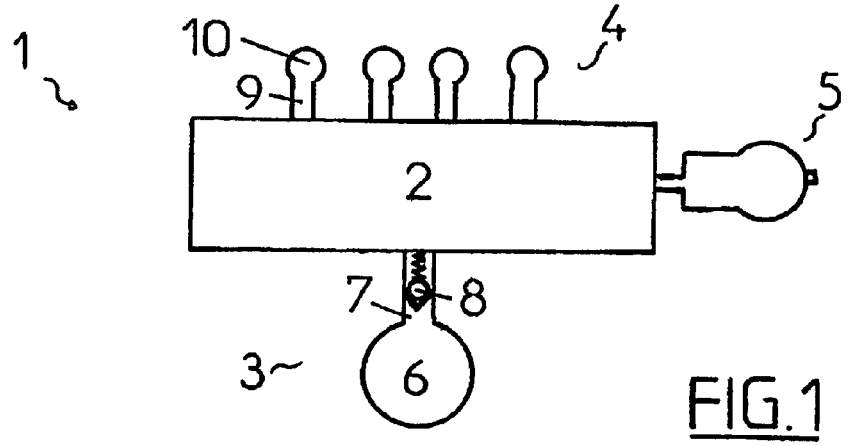
FIG. 1 is a schematic general view of the starting system according to the invention.

In the example illustrated on FIG. 1, it is visible that the starting system 1 according to the invention comprises mainly a common rail 2, supply means 3, injection means 4 and a pressurized fuel storage device 5.

The well-known operation of a common rail for internal combustion engine will not be described in detail in this patent.

In the example illustrated on FIG. 1, the supply means 3 are constituted by a high pressure pump 6, a conduit 7, and an anti-backflow valve 8. This pump will compress and send pressurized fuel to the common rail 2 through the conduit 7. The anti-backflow valve 8, mounted in this same conduit, is used to prevent fuel from flowing back into the pump 6 when the fuel pressure is higher in the common rail 2 than at the exit of said pump.

The injection means 4, in the example illustrated on FIG. 1, comprise mainly, for each cylinder of said engine, a pipe 9 and an injector 10. The pipe 9 makes it possible for the injector 10 to be connected to the common rail 2 and thus, to be supplied with pressurized fuel. Indeed, each injector can operate only with fuel at a minimum predetermined pressure. Thus, for an engine with four cylinders, it will be necessary to use four groups pipe 9-injector 10.

Figure 2:
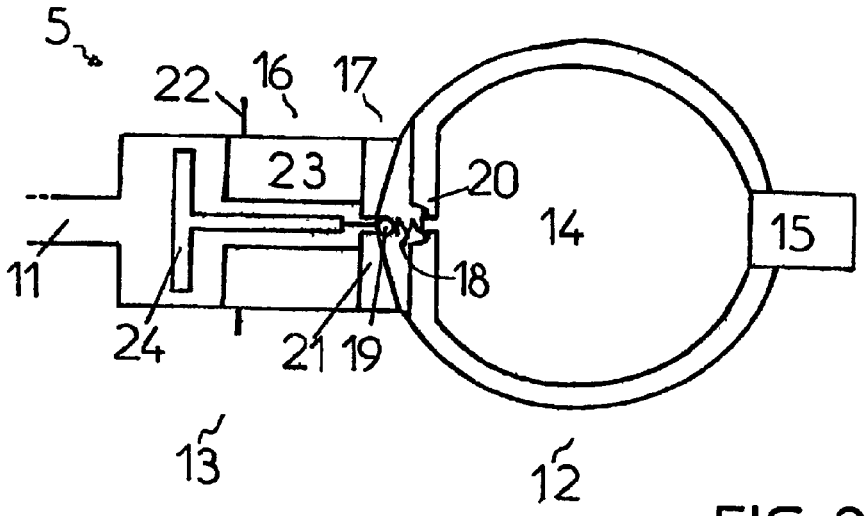
FIG. 2 is a schematic view of the fuel storage device according to the invention.

The pressurized fuel storage device 5 is, in the same illustrated example, in direct communication with the common rail thanks to a conduit 11. In the example illustrated on FIG. 2, it is visible more precisely that said storage device comprises storage means 12 and opening means 13.

The storage means 12 comprise mainly an enclosure 14 and a sensor 15. The first can contain fuel at a pressure at least equal to that supplied by the high pressure pump 6. The sensor 15 makes it possible to determine the fuel pressure inside said enclosure.

The opening means 13 enable the communication between the enclosure 14 and the conduit 11. These opening means comprise first elements with elastic properties 16 and second elements with electromagnetic properties 17, these two series of elements being mechanically linked.

Said first elements comprise a spring 18, a ball 19, a hollow spring seat 20 and a hollow ball seat 21. The spring seat 20 is used, not only to maintain the orientation of said spring, but also, thanks to its hollow, to communicate fuel between the opening means 13 and the storage means 12.

The spring 18 comprises, at its extremity opposed to said spring seat, the ball 19. This ball, following the responses of the spring to the applied forces, will impart a translation movement adapted to open or close the hollow of the ball seat 21, and thus, to enable the communication of fuel between the spring seat 20 and the conduit 11.

Said second elements comprise control electrodes 22, a coil 23, and an actuator 24. The electrodes 22 supply current to the coil 23 so as to induce a magnetic field adapted to move said actuator. In addition, the coil 23 is mounted against the ball seat 21 so that its inner diameter is centered on the same point as that of said hollow of the ball seat 21. Thus, in order to pass between the hollow of the ball seat 21 and the conduit 11, fuel must cross the inner diameter of the coil 23.

Figure 3:
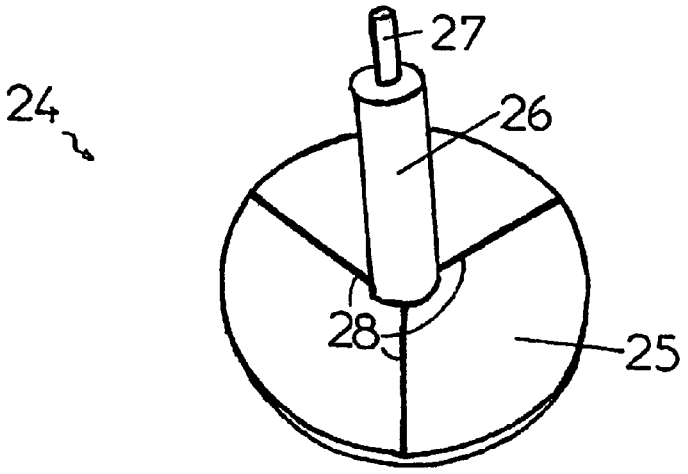
FIG. 3 is a view of the actuator according to the invention.

As illustrated in the example of FIG. 3, the actuator 24 comprises a circular plate 25, a first rod 26 and a second rod 27. The plate 25 has magnetic characteristics such that, during passage of the current in the coil 23, it will be attracted to the latter. In addition, the plate 25 has three grooves 28 equidistant from one another on the face facing said coil.

The first rod 26 is mounted integral with said plate so that said rod is found substantially along the central axis of the inner surface of the coil 23. The second rod 27 is fixed as an extension of the first rod 26. This second rod is thin, thinner than the first rod 26 and also than said hollow of the ball seat, so that it can pass through it.

In addition, according to the invention, the second rod 27 is in permanent contact with the ball 19, which makes it possible to link mechanically the elastic elements 16 and the electromagnetic elements 17. Thus, when the relative pressure of the fuel will push the ball 19 towards its seat 21, the actuator 24 will be moved away from the coil 23 or when the coil 23 will receive current, the actuator 24 will unseat the ball 24 from its seat 21.

During the first start-up, the storage means 14, which is filled with fuel at a low pressure, is not operational. The sensor 15 detects this situation, and does not authorize the storage device to open at start-up.

The engine is then started, and through the intermediary of the distribution element, the high pressure pump 6 is started. The inertia of the pump 6 is such that it does not supply immediately the minimum pressure required by the injectors 10. After this minimal pressure has been exceeded, the pump 6 will keep increasing pressure in the common rail 2, fuel will then be present in the conduit 11, around the plate 25, and in the hollow inner volume of the coil 23, in addition, the first injections are performed. The engine is then started.

When the pressure will have reached a minimum threshold in the common rail 2, the spring 18 weighed according to this threshold pressure will authorize passage of the fuel and thus authorize the storage means 14 to fill up. Depending on the relative pressure between the common rail 2 and the storage means 14, the spring 18 will contract or lose its tension so that the pressure of the fuel contained in the storage means 14 increases or remains stable, respectively.

When, in a random way with respect to the starting system, the driver decides to stop the engine, the high pressure pump 6 is stopped. The pressure in the common rail 2 diminishes, the spring 18 will lose its tension to push the ball 19 onto its seat 21 and thus block pressurized fuel in the storage means 14. The engine is then stopped and the storage device 5 is operational.

At the next start-up, the sensor 15 detects that the pressure is sufficient and then authorizes the release of the fuel contained in the storage means toward the common rail 2. This is performed by activation of the coil 23. The actuator will then be attracted against the coil 23 and thus push the ball 19 from its seat 21 thanks to the rods 26 and 27. The fuel contained in the storage means 14 is then released and will pass successively through the hollow of the spring seat 20, the hollow of the ball seat (around the rod 27), the grooves 28 of the plate 25, and the conduit 11.

Since the pump 6 does not yet supply a pressure higher than that induced by said release, the anti-backflow valve 8 blocks the conduit 7 and thus makes it possible to maintain the pressure due to the release constant in the common rail 2.

The pressure in the common rail 2 is then sufficient for a calculator (not shown) of the engine to authorize operation of the injectors 10. The high pressure pump 6 is then set in movement from the distribution elements of the engine, the first injections will have an accelerating effect regarding the performances of the pump 6, which will thus raise the pressure faster. Thus, when the pump 6 will supply a pressure higher than that existing in the common rail 2, the anti-backflow valve 8 of the conduit 7 will authorize the communication between said common rail and the pump 6 in order for the latter to take the succession of the storage device 5. At that instant, the coil 23 is then preferably deactivated.

Preferably, also, the storage means 14 is over-dimensioned so that two injection cycles can be performed before the high pressure pump supplies a pressure higher than that of the common rail 2.

When the pressure will have reached a minimum threshold in the common rail 2, the spring 18 weighed according to that threshold pressure will authorize the passage of fuel and thus authorize the storage means 14 to fill up. The cycle of the storage device 5 repeats itself as explained above to make it possible for said engine to have a start-up procedure that is short enough to adapt it to the technique called "stop and start".

Of course, the present invention is not limited to the example illustrated, but is susceptible to different variants and modifications which will be apparent to a person of the art. In particular, the location of the implantation of the storage device can be different. Also, the movement of the plate 24 can be made more linear thanks to stops accompanying the sliding movement of said actuator along the storage device 5. In addition, the anti-backflow valve 8 can be integrated to the high pressure pump 6. Finally, the system can operate without pressure sensor 15 and release the pressure contained in the storage means 14 thanks to an interval timer or another organ.

What is claimed is:

1. Starting system for internal combustion engine comprising pressurized fuel supply means, accumulator means supplied with pressurized fuel by said supply means, and at least one injection means supplied with fuel by the accumulator means, a pressurized fuel storage device supplied thanks to the pressure existing in said accumulator means and adapted to supply said stored fuel at start-up, the storage device, in direct communication with said accumulator means, comprising at least one storage means and control means, wherein said control means comprise electromagnetic opening means, elastic closing means, and an actuator means controlled selectively by said electromagnetic means and said elastic means so as to limit the energy to be supplied to control said starting system to make it possible for said engine to start up more rapidly, and wherein the elastic means authorizes passage of the fuel into the storage means when the pressure reaches a minimum threshold in the accumulator means.

2. System according to claim 1, wherein the electromagnetic means comprise a coil generating a magnetic field adapted to move the actuator means and whose inner diameter forms a tunnel between said at least one storage means and the accumulator means.

3. System according to claim 1, wherein the elastic means comprise a spring, a hollow plate fixed between said electromagnetic means and said storage means, and a ball adapted to block the hollow of said plate and integral with said spring, enabling the communication between the accumulator means and said at least one storage means, depending on the relative pressures between the two.

4. System according to claim 3, wherein the actuator means comprises a first rod located essentially on the central axis of said tunnel formed by the coil, a plate fixed essentially perpendicularly to an extremity of said first rod, and a second rod that, as an extension of the other extremity of the first rod, is in contact with said ball and has a diameter smaller than said hollow of the plate, making it possible to follow or to initiate the movement of said ball.

5. System according to claim 4, wherein the plate further comprises at least one groove adapted to let fuel pass in its hollow when said plate is against said electromagnetic means.

6. System according to claim 1, wherein the supply means comprise a pump supplying fuel to said accumulator means and an anti-backflow valve authorizing a fuel circulation direction only from the pump toward said accumulator means.

7. System according to claim 2, wherein the elastic means comprise a spring, a hollow plate fixed between said electromagnetic means and said storage means, and a ball adapted to block the hollow of said plate and integral with said spring, enabling the communication between the accumulator means and said at least one storage means, depending on the relative pressures between the two.

8. System according to claim 7, wherein the actuator means comprises a first rod located essentially on the central axis of said tunnel formed by the coil, a plate fixed essentially perpendicularly to an extremity of said first rod, and a second rod that, as an extension of the other extremity of the first rod, is in contact with said ball and has a diameter smaller than said hollow of the plate, making it possible to follow or to initiate the movement of said ball.

9. System according to claim 8, wherein the plate further comprises at least one groove adapted to let fuel pass in its hollow when said plate is against said electromagnetic means.

10. System according to claim 2, wherein the supply means comprise a pump supplying fuel to said accumulator means and an anti-backflow valve authorizing a fuel circulation direction only from the pump toward said accumulator means.

11. System according to claim 3, wherein the supply means comprise a pump supplying fuel to said accumulator means and an anti-backflow valve authorizing a fuel circulation direction only from the pump toward said accumulator means.

12. System according to claim 4, wherein the supply means comprise a pump supplying fuel to said accumulator means and an anti-backflow valve authorizing a fuel circulation direction only from the pump toward said accumulator means.

13. System according to claim 5, wherein the supply means comprise a pump supplying fuel to said accumulator means and an anti-backflow valve authorizing a fuel circulation direction only from the pump toward said accumulator means.

14. System according to claim 7, wherein the supply means comprise a pump supplying fuel to said accumulator means and an anti-backflow valve authorizing a fuel circulation direction only from the pump toward said accumulator means.

15. System according to claim 8, wherein the supply means comprise a pump supplying fuel to said accumulator means and an anti-backflow valve authorizing a fuel circulation direction only from the pump toward said accumulator means.

16. System according to claim 9, wherein the supply means comprise a pump supplying fuel to said accumulator means and an anti-backflow valve authorizing a fuel circulation direction only from the pump toward said accumulator means.

17. System according to claim 1, wherein the electromagnetic opening means and the elastic closing means are mechanically linked.

18. System according to claim 1, wherein the electromagnetic means and the elastic closing means are on a same conduit between said storage means and said accumulator means.

* * * * *